US005153543A

United States Patent [19]

Hitachi et al.

[11] Patent Number: 5,153,543

[45] Date of Patent: Oct. 6, 1992

[54] ELECTROMAGNETIC RELAY

[75] Inventors: Hideki Hitachi; Naoto Okihara; Masao Saito, all of Tokyo; Kazutoshi Kaneyama, Iwate, all of Japan

[73] Assignee: NEC Corporation, Tokyo, Japan

[21] Appl. No.: 773,232

[22] Filed: Oct. 9, 1991

[30] Foreign Application Priority Data

Oct. 15, 1990 [JP] Japan ..... 2-275858

[51] Int. Cl.[5] ..... H01H 51/22

[52] U.S. Cl. ..... 335/78; 335/80; 335/202

[58] Field of Search ..... 335/78-86, 335/124, 121, 128, 132, 131, 202

[56] References Cited

U.S. PATENT DOCUMENTS 4,419,643 12/1983 Ojima et al. ..... 335/234
4,539,539 9/1985 Schweiger et al. ..... 375/78
4,571,566 2/1986 Saür ..... 335/78
4,912,438 3/1990 Yokoo ..... 335/78
4,949,058 8/1990 Nishikawa et al. ..... 335/128

*Primary Examiner*—Lincoln Donovan
*Attorney, Agent, or Firm*—Laff, Whitesel Conte & Saret

[57] ABSTRACT

An electromagnetic relay of a flat configuration which can switch electric contacts by producing a seesaw movement of an armature. The relay has an armature assembly having moveable contacts, a coil assembly implemented as a coil spool having a core and wound with a coil, and an insulating base supporting stationay contacts, coil terminals, and connection terminals. The coil assembly is built in the base by affixing the coil terminals of the coil assembly to coil terminals of the base, and then the base is molded to cover the whole coil assembly except for both ends of the core and a bore for receiving a permanent magnet. The base, therefore, fully spaces apart the joints of the coil terminals and the contacts and spaces apart the coil and the contacts.

7 Claims, 6 Drawing Sheets

ELECTROMAGNETIC RELAY

BACKGROUND OF THE INVENTION

The present invention relates to an electromagnetic relay of a flat configuration which can switch electric contacts by producing a seesaw movement of an armature.

An electromagnetic relay of the type described is disclosed in, for example, U.S. Pat. No. 4,912,438 assigned to the same assignee as the present invention. The relay described in this U.S. patent has a movable armature assembly having movable contacts, a coil assembly implemented as a coil spool having a core and wound with a coil, and an insulating base supporting stationary contacts, coil terminals, and connection terminals. Such a conventional relay has a drawback that the space or insulation distance available between the joints of coil terminals and the contacts and the space or insulation distance available between the coil and the contacts are limited, whereby the withstanding voltage available between the coil and the contacts is limited. Generally, the contact force of contacts, which is one of major factors that determine the characteristics of an electromagnetic relay, is dependent on the distance between the ends of the core and the stationary contacts. Therefore, another problem with the above-stated prior art relay is that the combination of the coil assembly and the base which are physically independent of each other and include the core and the stationary contacts, respectively, effects the distance between the ends of the core and the stationary contacts, rendering the contact force unstable. Moreover, after the assembly of the relay, the above-mentioned distance changes with the changes in temperature and other environmental conditions to thereby influence the characteristics of the relay.

SUMMARY OF THE INVENTION

It is, therefore, an object of the present invention to provide an electromagnetic relay which increases the withstanding voltage between a coil and contacts.

It is another object of the present invention to provide an electromagnetic relay which provides each contact with a stable contact force.

It is another object of the present invention to provide an electromagnetic relay which is immune to changes in ambient conditions.

It is another object of the present invention to provide a generally improved electromagnetic relay.

An electromagnetic relay of the present invention comprises a coil assembly comprising a U-shaped core, coil terminals molded integrally with the core by an insulating member, and a coil spool would with a coil, a permanent magnet mounted on a central portion of the core, a movable armature assembly comprising an armature positioned such that opposite ends thereof face opposite ends of the core, hinge spring portions for supporting the armature such that the opposite ends of the armature seesaws toward and away from the opposite ends of the core, and movable contact springs movable in interlocked relation to the seesaw movement of the armature and each having a movable contact at the free end thereof, the armature, hinge spring portions and movable contact springs being molded integrally with one another by an insulating member, and an insulating base comprising stationary contact terminals each having a stationary contact which is associated with respective one of the movable contacts, common terminals each connecting to one end of respective one of the hinge spring portions, and coil terminals each connecting to respective one of the coil terminals, the base being integrally molded by an insulating member, the base being integrally molded such that the insulating member covers the coil assembly, whereby the coil assembly is accommodated in the base.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 1:
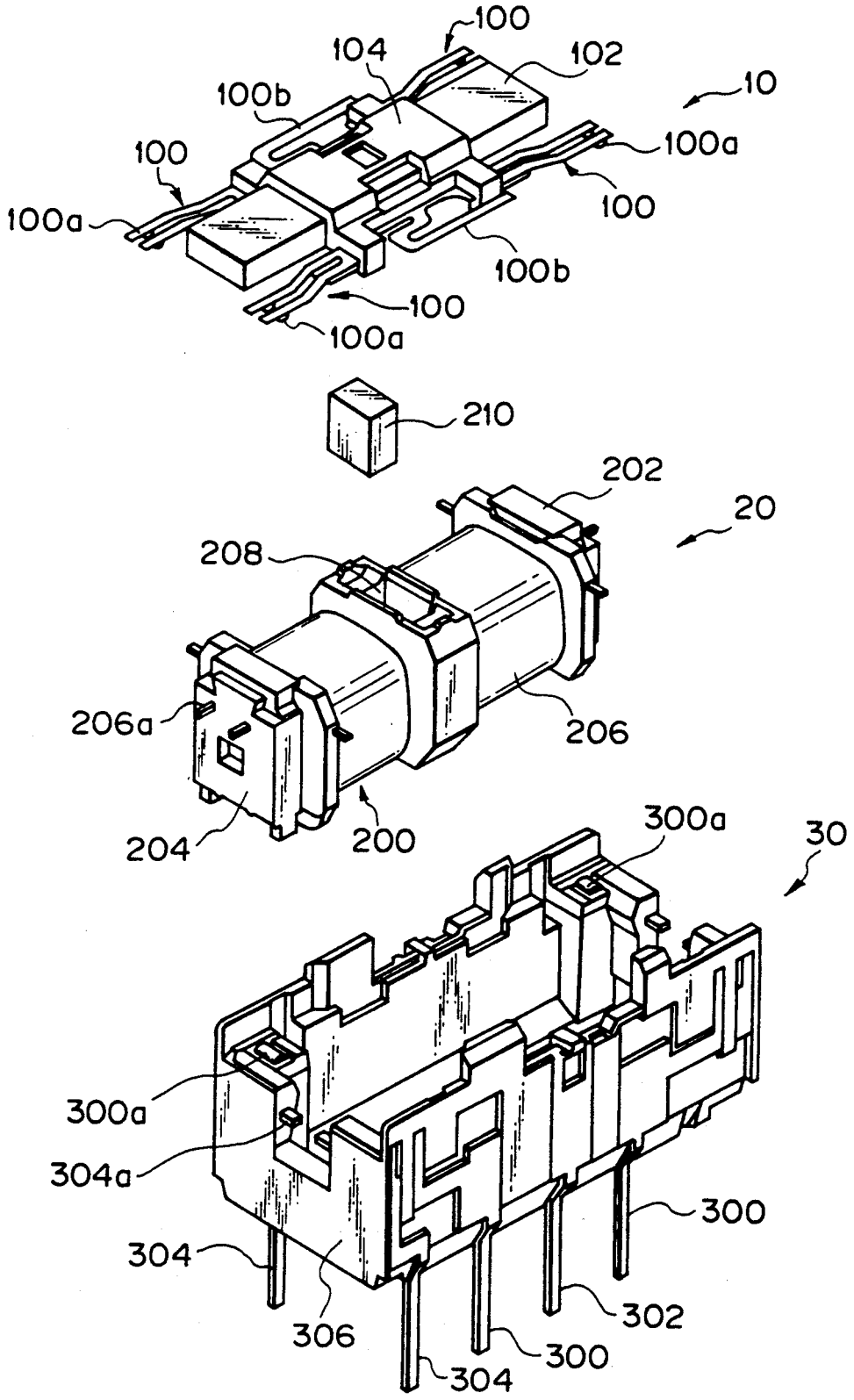
Fig. 1 PRIOR ART
FIG. 1 is an exploded perspective view of a conventional electromagnetic relay.

To better understand the represent invention, a brief reference will be made to a prior art electromagnetic relay, shown in FIG. 1. As shown, the conventional relay is generally made up of an armature assembly 10, a coil assembly 20, and an insulating base 30.

The armature assembly 10 has two movable contact springs 100 each having a movable contact 100*a* and a hinge spring portion 100*b*. The contact springs 100 are located at both sides of an armature 102 and joined together by a fixing body 104. The coil assembly 20 has a coil spool 200 constituted by a generally U-shaped core 202 and insulating members 204 each having coil terminals 206*a* embedded therein. A coil 206 is wound around the coil spool 200. A permanent magnet 210 nests in a bore 208 formed in the central portion of the U-shaped core 202. The base 30 has a box-like member 306 made of an insulating material and having an opening on the top thereof. Stationary contact terminals 300 to which stationary contacts 300*a* are affixed, common terminals 302 and coil terminals 304 are buried in the box 306.

To assemble the relay having the above construction, the coil assembly 20 is fitted in and affixed to the base 30, and then the coil terminals 206*a* and the coil terminals 304*a* are joined together by welding or similar technology. The armature assembly 10 has the hinge spring portions 100*b* thereof connected to the common terminals 302. Finally, a cover, not shown, is fitted on the resulting assembly. The armature 102 has projections, not shown, in a central portion of the underside thereof, forming a fulcrum for the seesaw movement of the armature assembly 10. The projections rest on the upper surface of the permanent magnet 210.

A problem with the conventional relay described above is that the withstanding voltage available between the coil 206 and the contacts 100*a* or the contacts 300*a* is limited since a sufficient space or insulation distance is not available between the joints of the coil terminals 206*a* and 304 and the contacts 100*a* or 300*a*. Another problem is that the distance between the end of the core 202 and each stationary contact 300*a* is effected by the combination of the coil assembly 20 and the base 30 which are physically independent of each other and have the core 202 and the stationary contacts 300*a*, respectively, resulting in an unstable contact force. Further, after the assembly of the relay, the above-mentioned distance is effected by temperature and other ambient conditions to in turn effect the characteristics of the relay.

Preferred embodiments of the electromagnetic relay in accordance with the present invention will be described with reference to FIGS. 2 to 6. In the figures, the same or similar elements as the elements shown in FIG. 1 are designated by the same reference numerals, and redundant description will be avoided for simplicity.

Figure 2:
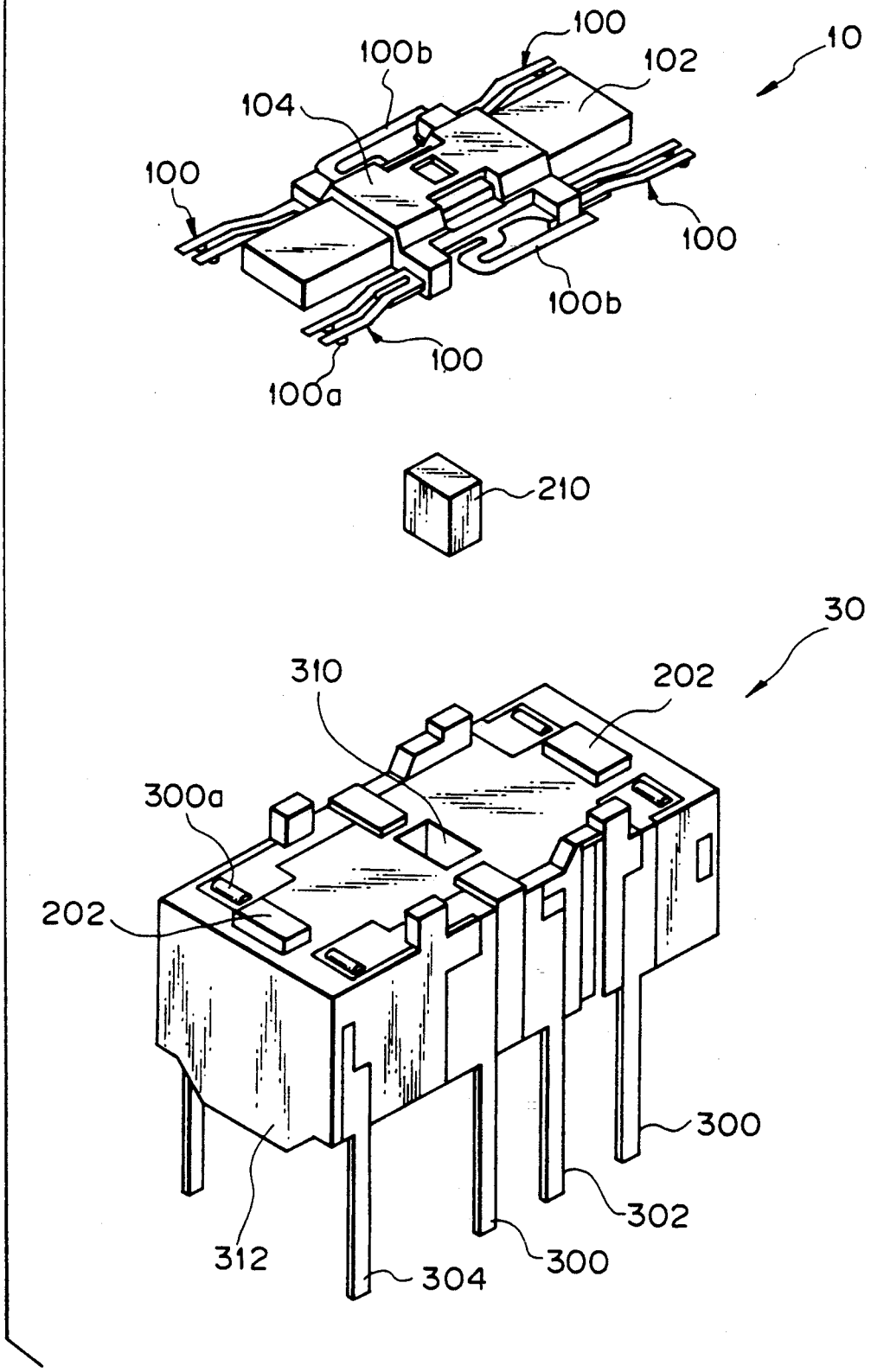
FIG. 2 is an exploded perspective view of an electromagnetic relay embodying the present invention.
Figure 3:
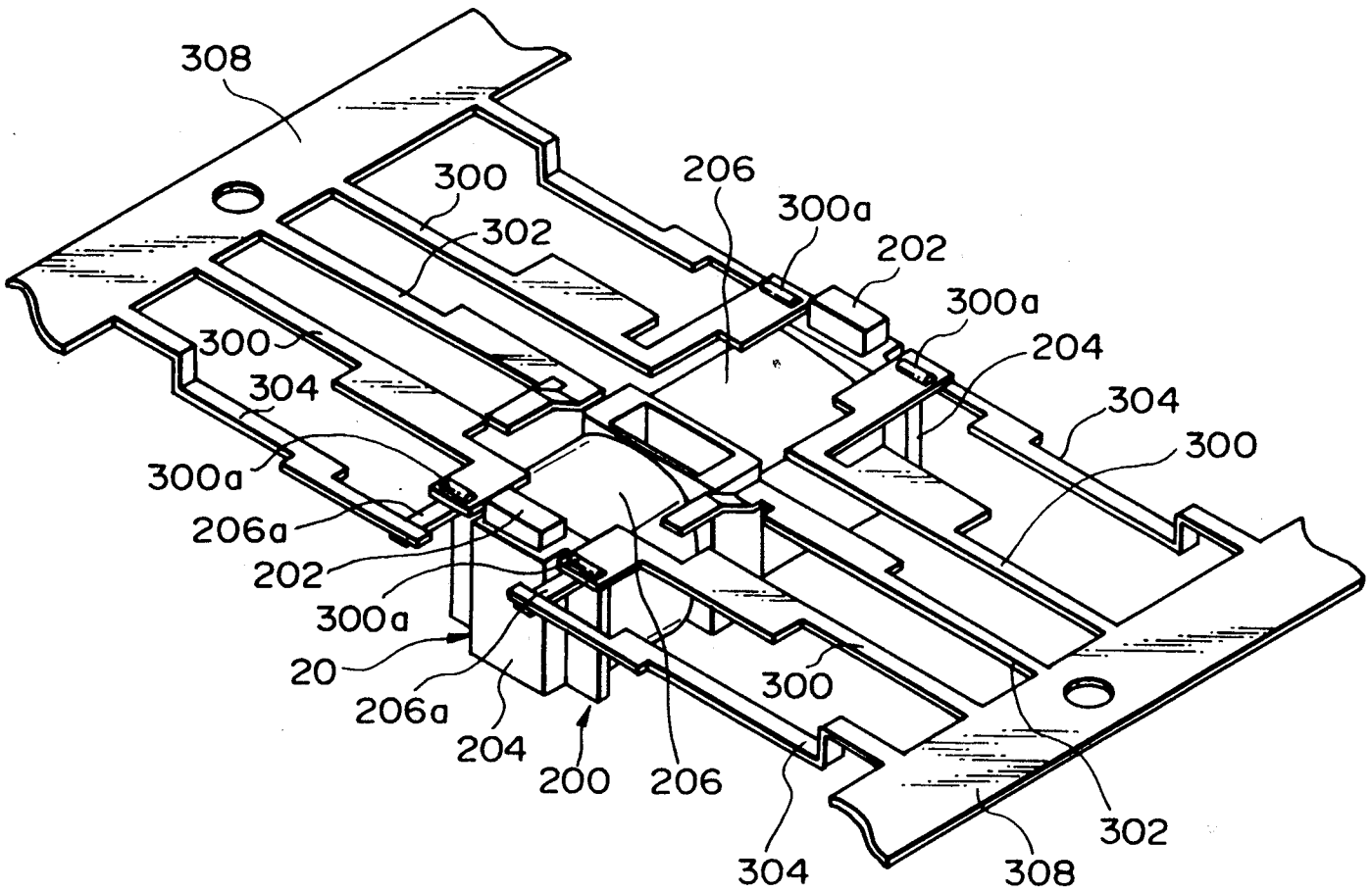
FIGS. 3 and 4 are perspective views showing a procedure up to a step of molding an insulating base included in the embodiment.
Figure 4:
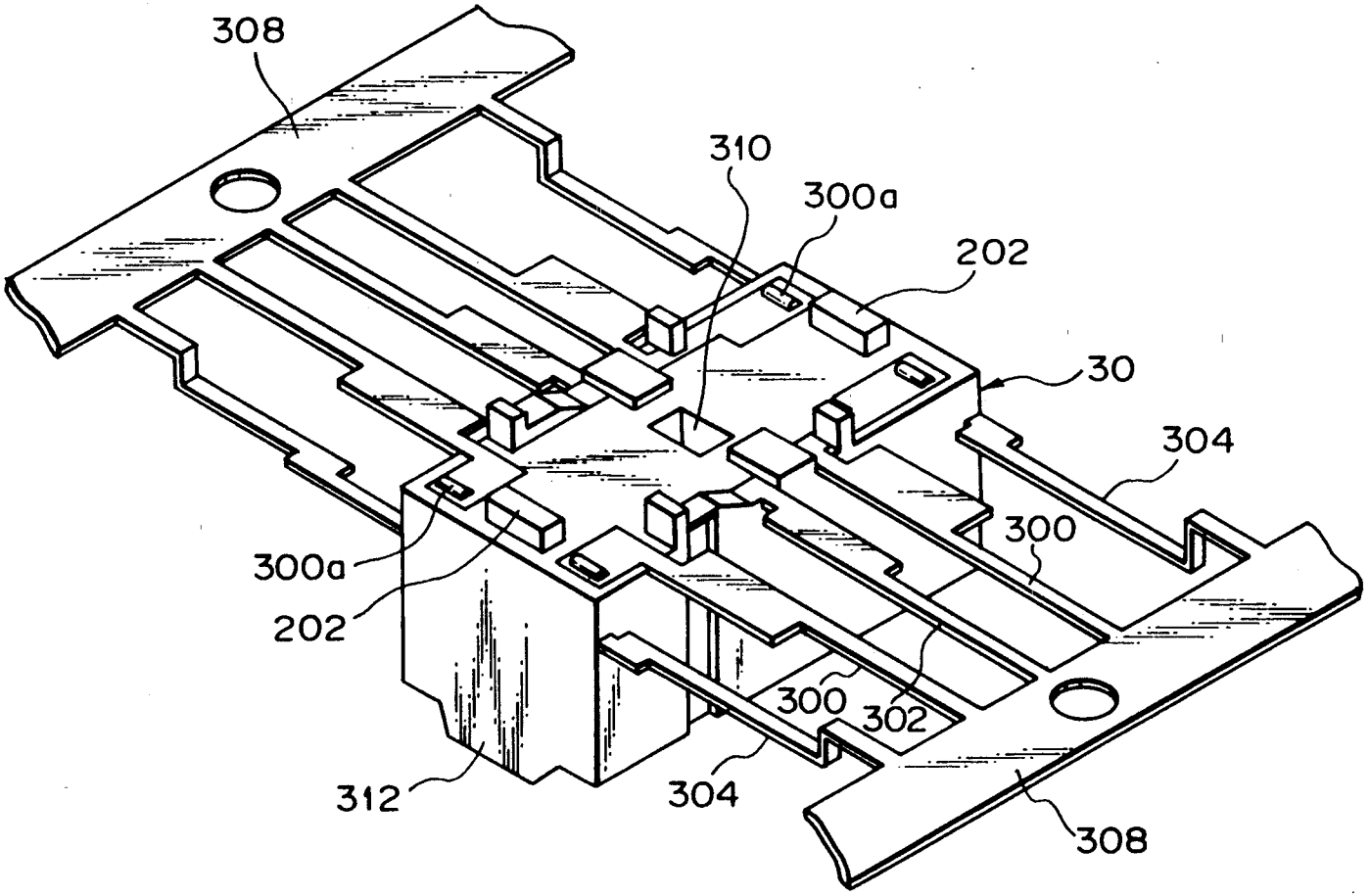

Referring to FIG. 2, an electromagnetic relay embodying the present invention is shown and includes an insulating base 30 having a unique configuration. The base 30 will be described specifically with reference also made to FIGS. 3 and 4. As shown in FIG. 3, a coil spool 200 is affixed to strip-like terminal blanks 308 which are formed by pressing or otherwise shaping strip-like thin leaf springs. Each terminal blank 308 includes terminals 300, 302 and 304. The coil spool 204 has coil terminals 206*a* thereof welded to or otherwise connected to the coil terminals 304. In this condition, a coil assembly 20 is molded together while being fully enclosed by an insulating body 312 except for opposite ends of a U-shaped core 202 and a bore 310 for receiving a permanent magnet. FIG. 4 shows the resulting base assembly 30. As shown in FIGS. 3 and 4, each terminal blank 308 including the terminals 300, 302 and 304 is implemented as a single strip and allows the coil terminals 206*a* to be connected to the coil terminal 304, i.e., the coil assembly 20 to be affixed to the terminal blank 308 and allows the base 30 including the coil assembly 20 and terminals to be produced by molding. In the condition shown in FIG. 4, a permanent magnet 210, FIG. 2, is inserted in the bore 310 of the base 30, and then a movable armature assembly 10, FIG. 2, is affixed to the base 30 by having hinge spring portions 100*b* thereof affixed to common terminals 302. Finally, a cover, not shown, is fitted on the resulting assembly to complete a relay.

Figure 5:
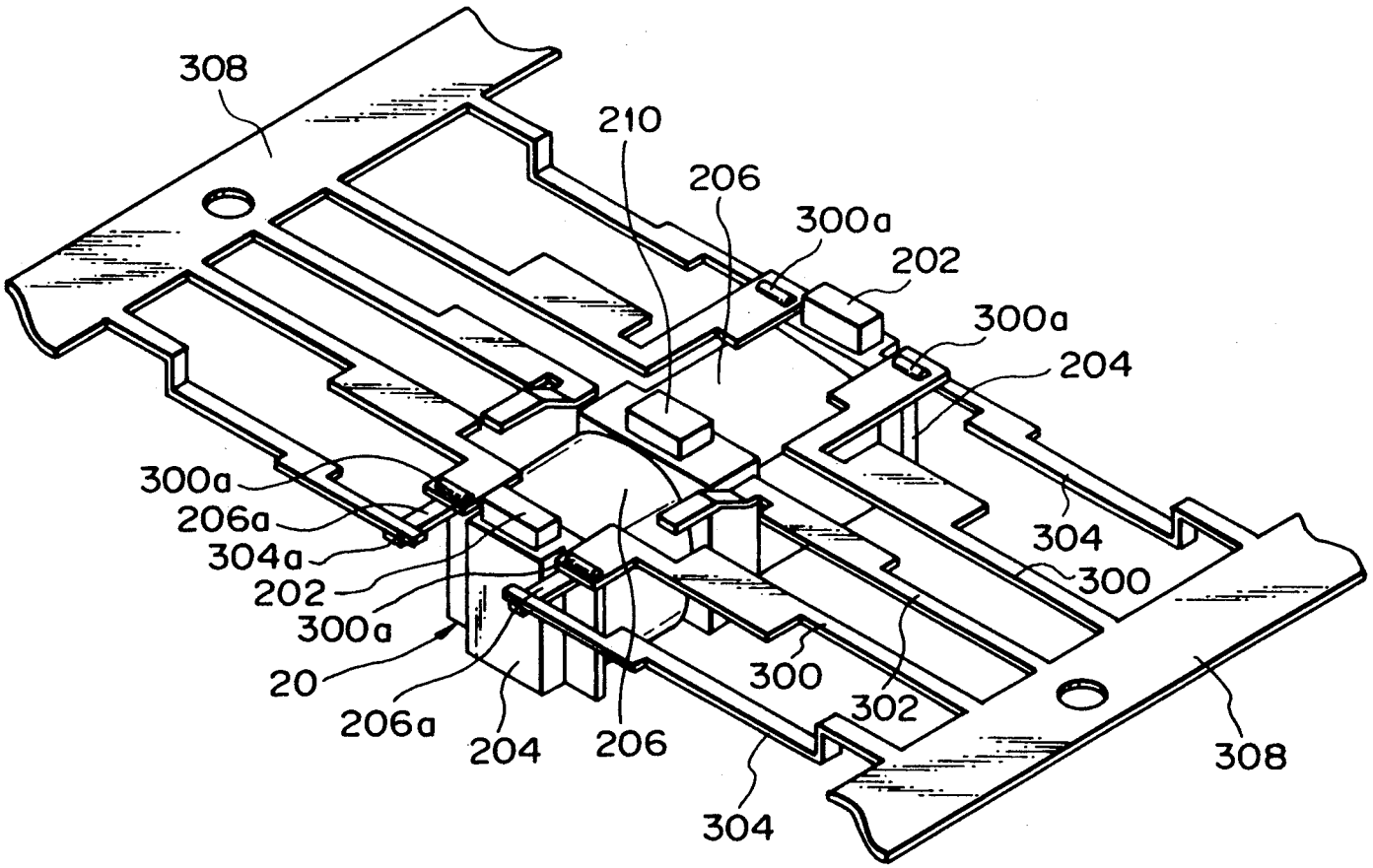
FIGS. 5 and 6 are perspective views showing an alternative embodiment of the present invention.
Figure 6:
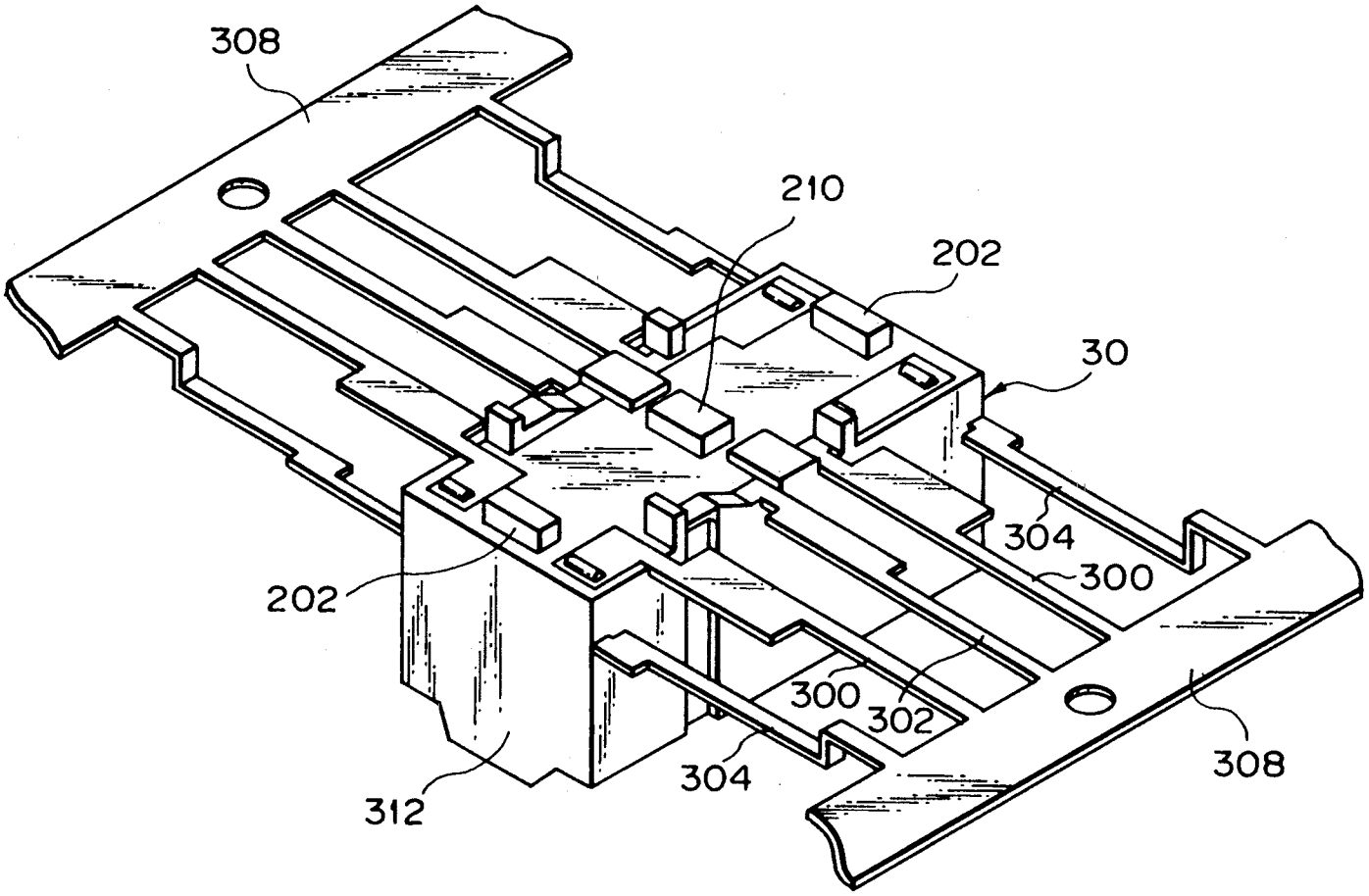

An alternative embodiment of the present invention will be described with reference to FIGS. 5 and 6. As shown in FIG. 5, the permanent magnet 210 is affixed to the coil assembly 20 before the molding of the base 30. After the coil terminals 206*a* have been connected to the coil terminals 304, the base 30 having a configuration shown in FIG. 6 is completed by molding. It is to be noted that the permanent magnet 210 may be affixed to the coil block 20 either before or after the connection of coil terminals 206*a* to the coil terminals 304.

In summary, in accordance with the present invention, an electromagnetic relay has a coil assembly built in an insulating base by affixing the coil terminals of the coil assembly to the coil terminals of the base, and then molding the base to cover the whole coil assembly except for both ends of a core and a bore for receiving a permanent magnet. The base, therefore, fully spaces apart the joints of the coil terminals and contacts and spaces apart the coil and the contacts, remarkably increasing the withstanding voltage between the coil and the contacts. Since the coil assembly and the base are molded integrally with each other, the distance between the ends of the core included in the coil assembly and the stationary contacts of the base and, therefore, the contact force of contacts which is dependent on such a distance is stabilized. This provides the relay with extremely stable characteristics. Moreover, the distance between the ends of the core and the stationary contacts is little susceptible to temperature and other ambient conditions, insuring the resistivity of the relay to changes in environmental conditions. In addition, the relay of the present invention is achievable with a minimum number of parts.

Various modifications will become possible for those skilled in the art after receiving the teachings of the present disclosure without departing from the scope thereof.

What is claimed is;

1. An electromagnetic relay comprising:

a coil assembly comprising, a U-shaped core, coil terminals molded integrally with said core by an insulating member, and a coil spool wound with a coil;

a permanent magnet mounted on a central portion of said core;

a movable armature assembly comprising an armature positioned such that opposite ends thereof face opposite ends of said core, hinge spring portions for supporting said armature such that said opposite ends of said armature seesaws toward and away from said opposite ends of said core, and movable contact springs movable in interlocked relation to the seesaw movement of said armature and each having a movable contact at the free end thereof, said armature, said hinge spring portions and said movable contact springs being molded integrally with one another by an insulating member; and an insulating base comprising stationary contact terminals each having a stationary contact which is associated with respective one of said movable contacts, common terminals each connecting to one end of respective one of said hinge spring portions, and coil terminals each connecting to respective one of said coil terminals, said base being integrally molded by an insulating member;

said base being integrally molded such that said insulating member covers substantially the majority of said coil assembly, wherein said coil assembly is accommodated in said base.

2. A relay as claimed in claim 1, wherein said base is molded integrally after said coil terminals of said coil assembly have been connected to said coil terminals of said base.

3. A relay as claimed in claim 1, wherein said base is molded integrally after said coil terminals of said coil assembly have been connected to said coil terminals of said base and said permanent magnet has been mounted on said coil assembly.

4. A relay as claimed in claim 1, wherein said base is molded integrally with said opposite ends of said core exposed to the outside.

5. A relay as claimed in claim 1, wherein said base is molded integrally with said core for receiving said permanent magnet exposed to the outside.

6. A relay as claimed in claim 1, wherein said base is molded integrally with a fixing portion for fixing said coil assembly in place in a mold exposed to the outside.

7. A relay as claimed in claim 1, wherein said base is molded in the form of strip-like terminal blanks having said stationary terminals, said common terminal and said coil terminal connected at one end to said terminal blanks.

* * * * *